US005459975A

United States Patent [19]

Till

[11] Patent Number: 5,459,975

[45] Date of Patent: Oct. 24, 1995

[54] COMPRESSIBLE RING CHUCK

[75] Inventor: Paul A. Till, Middleton, Mass.

[73] Assignee: Vibrac Corporation, Amherst, N.H.

[21] Appl. No.: 163,898

[22] Filed: Dec. 7, 1993

[51] Int. Cl.[6] ..... B67B 7/14; B67B 7/18

[52] U.S. Cl. ..... 53/381.4; 53/357; 73/847; 73/862.21; 73/862.23

[58] Field of Search ..... 53/331.5, 317, 53/362, 75, 381.4; 73/862.23, 847, 862.21

[56] References Cited

U.S. PATENT DOCUMENTS

| | | | |
|---|---|---|---|
| 2,705,101 | 3/1955 | Everett | 53/362 X |
| 3,491,516 | 1/1970 | Bergeron | 53/331.5 X |
| 3,866,463 | 2/1975 | Smith et al. | 73/99 |
| 3,955,341 | 5/1976 | Wilhere | 53/331.5 |
| 4,539,852 | 9/1985 | Feld | 73/847 |
| 4,696,144 | 9/1987 | Bankuty et al. | 53/331.5 |
| 4,716,772 | 1/1988 | Bubeck et al. | 73/862.23 |
| 4,794,801 | 1/1989 | Andrews et al. | 73/862.23 |
| 4,811,850 | 3/1989 | Bankuty et al. | 209/546 |
| 4,907,700 | 3/1990 | Bankuty et al. | 209/546 |
| 5,152,182 | 10/1992 | Searle | 73/862.23 |

FOREIGN PATENT DOCUMENTS

| | | | |
|---|---|---|---|
| 15587 | 12/1933 | Australia | 53/362 |
| 574615 | 5/1932 | Germany | 53/362 |
| 141347 | 11/1934 | Germany | 53/362 |

*Primary Examiner*—Horace M. Culver
*Attorney, Agent, or Firm*—Pandiscio & Pandiscio

[57] ABSTRACT

A chuck for grasping bottle caps is provided for use in machines for torque-testing bottle caps. The chuck comprises a housing having an open-ended cavity, with an annular plate fastened within the housing's open end. The plate provides a seat for a flat elastomeric ring and also constrains the ring against radial expansion. The elastomeric ring defines an opening to accommodate a cap to be tested. The housing further accommodates a metal pusher member which normally engages the inner end of the elastomeric ring. A camming mechanism mounted within the cavity is arranged to apply a force to move the pusher member against the elastomeric ring and this force coacts with the constraining force of the annular plate to cause the elastomeric ring to expand inwardly into tight gripping engagement placed with a cap disposed within the elastomeric ring, whereby torque can be applied to the cap by rotation of the chuck without deforming the cap.

5 Claims, 1 Drawing Sheet

COMPRESSIBLE RING CHUCK

FIELD OF THE INVENTION

This invention relates generally to devices for grasping an object which will then be subjected to the application of torque forces, and is more particularly concerned with a chuck used in torque measurement on a variety of devices and articles.

BACKGROUND OF THE INVENTION

It is desirable in many industries to measure the torque between two relatively rotatable components which have a torque resistance between them. One example is the soft drink beverage industry where bottle-type containers are closed off by screw-type caps. Such threaded caps can be of the type having fully threaded members which must be screwed on tight to seal the contents, and subsequently unscrewed by hand action to permit dispensing of the contents. More commonly today, such threaded caps are of the type having only vestigial threads requiring a twist-off rupturing action for removal of the cap. Both types of caps must be applied so as not to leak, but may not be so tight as to make it difficult for the consumer to remove the cap by hand action only. Consequently, the amount of torque required for either type of cap must be within predetermined limits. Similar constraints apply to screw-type caps for other consumer products such as toothpaste, shampoo, and lotions of various sorts.

In such industries, particularly the soft drink industry, which employ capped containers it is a common practice to measure, on a sampling basis and for quality control purposes, the required cap removal force in order to determine whether it is within a desired range. Many different types of torque measuring devices and systems have been employed for such purposes. These range from simple cap testers to relatively complex ones, all of them employing means for grasping or gripping the caps and containers, and means for rotating one relative to the other.

A problem exists with the grasping means especially employed in cap testing in that too much compression force may be placed on the cap so that it is damaged, or deformed, thereby resulting in faulty torque readings, or the inability to measure torque. This is particularly a concern where it is desired to measure the torque required to remove and/or secure smooth metal caps.

Various devices have previously been suggested to serve as grasping means for caps in torque measuring systems. In one such bottle cap remover/torque tester, as shown by U.S. Pat. No. 4,794,801, issued Jan. 3, 1989 to T. M. Andrews et. al., a chuck comprising a circular disk having a shallow concave, conical dish shape on one side is provided with radiating teeth. These teeth are formed out of hardened steel and are sharp, and the teeth positively engage the cap at its periphery. Such teeth bite into the softer material of the cap, typically plastic or aluminum. Although the purpose of the chuck is to avoid rotational slippage, such a chuck may chew-up the cap, and may indeed rupture it to give faulty readings.

In another cap torque tester, such as shown by U.S. Pat. No. 4,539,852, issued Sep. 10, 1985 to Jerome H. Feld, a metal coil spring is used as a chuck. The coil spring has an inner diameter which is somewhat less than the outer diameter of the cap. A torque arm is provided to enable opening and closing of the coils of the spring, so that it can be placed over the cap and then tightened around the periphery of the cap. Such steel spring may also deform the cap periphery as it continues to be tightened and torque is applied. False readings can be obtained because if the cap is deformed, resistance to a torque force applied to unscrew the deformed cap may be greater than to an undeformed cap. This coil spring chuck will thus not duplicate the torque force applied by the human hand.

Another type of chuck for removing caps in a torque tester is shown in U.S. Pat. No. 4,716,772 issued Jan. 5, 1988 to K. B. Bubech et. al., which employs a motor driven three-jaw gripping device to grip and rotate the cap. This is similar to collets used in machine tools. However, it is not fully satisfactory for performing torque measurements on metal caps, since these jaws may put too much radial compression on the metal caps. In a similar arrangement as shown in U.S. Pat. No. 3,866,463, issued Feb. 18, 1975 to David A. Smith et. al. the bottle is rotated but the cap is held stationary by a three jaw chuck, with the same unwanted possibility of applying excessive radial compression on the cap.

Cap-grasping jaws in torque testing machines have been provided with elastomer (e.g. polyurethane) lined inserts as shown in U.S. Pat. No. 4,696,144, issued Sep. 29, 1987 to Geza A. Bankuty et. al. Although less surface damage may result because of the presence of elastomer, the grasping force is still applied radially to the cap by positively driven jaws. Thus, excessive radial compression may still be placed on the cap, with the result that the cap may be deformed.

A still further form of cap grasping mechanism is shown in U.S. Pat. Nos. 4,811,850 and 4,907,700 issued Mar. 14, 1989 and Mar. 13, 1990, respectively, to Geza A. Bankuty et. al. The cap grasping chuck described therein comprises a series of vertically arranged fingers deployed to surround the cap. The individual fingers each have an elastomeric coating on their inner lower portions. The upper portions of the fingers are surrounded by a collet ring which acts as a cam, and such collet can be moved downwardly on conical surfaces on the upper part of the fingers in order to cause the fingers to be flexed inwardly at their lower ends into cap grasping engagement. This form of engagement of a cap is equivalent to a multi-jaw chuck, even though the fingers are flexed inwardly rather than positively driven inwardly. This arrangement suffers from the possibility of the cap being distorted, despite the fact that the fingers are lined with elastomer, because steel fingers are used to apply a compression load radially to the cap. Also, the mechanism is relatively complicated.

SUMMARY OF THE INVENTION

The primary object of the present invention is to provide a chuck to facilitate torque measurements of containers having screw-type closures, wherein the chuck does not operate to physically mar or distort the closure during the measurement process.

Another object of the present invention is to provide a chuck for grasping smooth metal caps of containers for purposes of torque measurement without applying forces which distort the torque measurement.

A further object of the invention is to provide a ring chuck for grasping a screw-type closure of a container which can apply sufficient radial forces to the closure to enable its rotation relative to the container, without applying that degree of radial compression to the cap which will deform it.

A still further object of the invention is to provide a chuck adapted to grasp metal caps for measurement of the release torque required for removing the cap from a container to which it is assembled, wherein the chuck fits closely to the surface of the cap prior to its operation, and thereafter is closed tightly about the cap to surround and enclasp the periphery of the cap so as to permit removal of the cap upon rotation of the chuck.

Still another object is to provide a chuck for use with a torque-measuring device of the kind incorporating the invention described in U.S. Pat. No. 5,152,182, issued Oct. 6, 1992 to Robert F. Searle for "Torque Measuring Apparatus".

These and other objects hereinafter described, or rendered obvious, are achieved by a chuck device that comprises a housing incorporating a flat elastomeric ring. The ring is captured within an annular metal plate. The elastomeric ring is substantially constrained by the annular plate to move only radially inwardly. The housing is open at its lower end to enable it to be placed around a container cap, and such opening is in alignment with the central opening of the ring. The housing further includes a metal pusher element arranged to engage the upper surface of the elastomeric ring. A camming mechanism is provided in the upper part of the housing and includes a cam element having a camming surface which can be moved to apply a downward force to the pusher element. A metal washer element is placed between the camming surface and the upper surface of the pusher element to avoid undue wearing of the upper surface of such pusher element. As the chuck is placed around a cap, the cap passes through the opening in the housing and enters the opening in the ring, which loosely engages the cap. The camming mechanism is then operated to move the pusher element downwardly to compress the elastomeric ring so as to cause the elastomer to expand inwardly to surround and enclasp the periphery of the cap. When said chuck is thereafter rotated, sufficient torque force will be applied to the cap to either remove it from or secure it to a container, depending on the direction of rotation of the chuck.

BRIEF DESCRIPTION OF THE DRAWINGS

A complete understanding of the nature and objects of the present invention will become more readily apparent, or will be rendered obvious, upon a reading of the detailed description of a preferred embodiment following hereinafter, and upon an examination of the accompanying drawings, in which like parts are identically numbered, and wherein.

DETAILED DESCRIPTION OF THE PREFERRED EMBODIMENT

Figure 1:
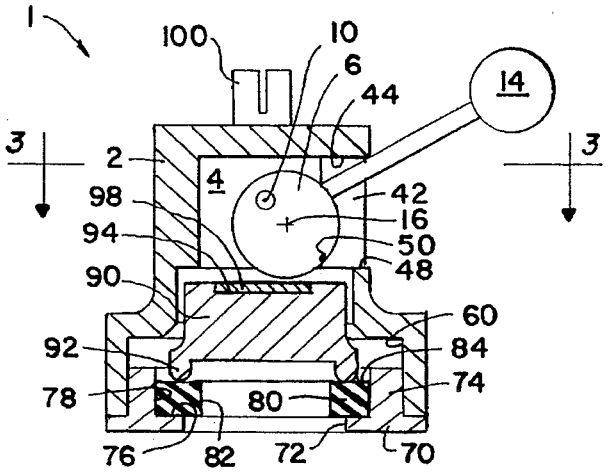
FIG. 1 is a cross-sectional view centrally through a preferred embodiment of the compressed ring chuck of the present invention, wherein the cam operating handle is in the raised position.
Figure 2:
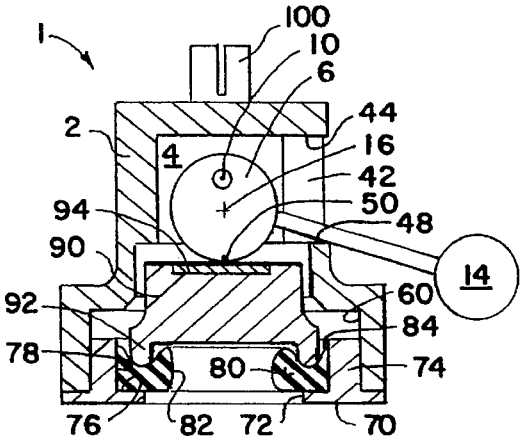
FIG. 2 is a view like FIG. 1 but showing the cam operating handle in the lowered position.

Referring now to FIG. 1, the preferred embodiment of the invention comprises a compressed ring chuck indicated generally at 1. This chuck includes a housing 2 which is provided with several cavities or openings. An upper cavity 4 houses a disk-shaped circular cam 6, which is mounted to be rotated on an eccentric axis 10. Axis 10 is eccentric in the sense that it is eccentric to the center axis 16 of cam 6. The rotation is accomplished by moving a cam operating handle 14, which is secured to and extends outwardly from cam 6. Because of the offset relationship between the axes 10 and 16 the cam may be rotated between an "upper" position, as shown in FIG. 1, to a "lower" position, as shown in FIG. 2. In this context, the terms "upper" and "lower" are used with reference to the effect of cam position on the position of the pusher element 90 (hereinafter described) which is used to transmit a driving force to elastomeric ring 80 (also hereinafter described).

Figure 3:
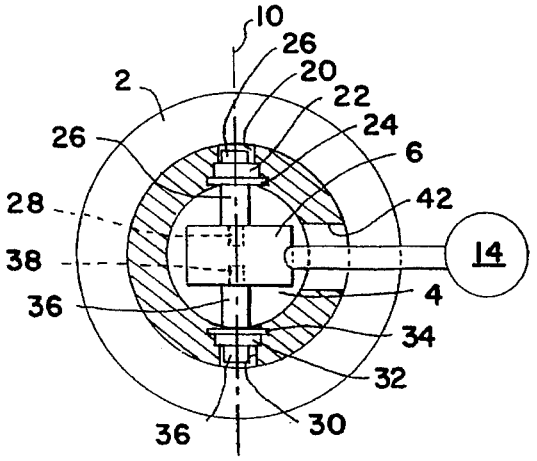
FIG. 3 is a cross-sectional view taken along line 3—3 of FIG. 1.

One method of mounting the cam 6 within the housing 2 is shown in FIG. 3. A radially-extending bore 20 is formed in one side of the housing leading to the cavity 4. A bearing 22 is retained within an enlarged portion of the bore 20 by means of a snap ring 24. A stub shaft 26 is disposed so as to extend through bearing 22. The inner end of the shaft 26 is threaded at 28 and is screwed into a threaded eccentric opening in cam 6. The same arrangement is provided on the other side of the cam 6, wherein a second radially-extending bore 30 is formed on the opposite side of the housing in axial alignment with bore 20. The bore 30 also leads to the cavity 4. A bearing 32 is retained within an enlarged portion of the bore 30 by means of a snap ring 34. A second stub shaft 36 is disposed to extend through bearing 32 in axial alignment with stub shaft 26. The inner end of the shaft 36 is threaded at 38 and screwed into another radially-extending eccentric threaded opening in cam 6 that is in alignment with the threaded opening for stub shaft 26. As a result, the coaxial stub shafts 26 and 36 cooperate to establish the eccentric axis of rotation 10. Rotation of the cam 6 about axis 10 is accomplished by moving the handle 14 vertically from the position shown in FIG. 1 to the position shown in FIG. 2.

Handle 14 extends through a side opening 42 in housing 2 which leads to cavity 4. Movement of the handle and cam 6 (vertically as viewed in FIGS. 1 and 2) is restricted by the vertical dimensions of side opening 42. As shown in FIGS. 1 and 2, opening 42 is defined in part by upper and lower surfaces 44 and 48, respectively. Surface 44 acts as a stop for upward movement of the cam handle 14 (FIG. 1) and surface 48 acts as a stop for downward movement of the cam handle 14 (FIG. 2). The lowermost positions of handle 14 and cam 6 are reached when the handle engages surface 48 (i.e., the position shown in FIG. 2).

Because the pivot axis of cam 6 is eccentric to the center point of the cam, movement of handle 14 causes the cam to rotate as an eccentric, with the result that the point 50 on the cam (FIG. 1) can be moved downward from the position shown in FIG. 1 to the position shown in FIG. 2 when the cam handle 14 is moved from its upper limit position in engagement with surface 44 to its lower limit position in engagement with surface 48. Preferably the surfaces 44 and 48 are spaced from one another to allow the handle to move through an angle of about 45°.

As seen in FIGS. 1 and 2, the bottom end of the housing 2 is formed so as to provide an enlarged opening 60 which is in communication with the cavity 4. Opening 60 is sized to receive several elements. One of these elements is a rigid bottom plate 70 which is preferably made of a metal, e.g. steel or aluminum, and has an annular configuration. Plate 70 comprises a cylindrical body section 74 and a radially-extending flat flange section 72 which protrudes radially outwardly and inwardly from body section 74. The latter is sized to make a close fit in housing opening 60 and is affixed to housing 2 by a press fit or by welding, a screw thread connection or in some other rotatable manner. The upper surface of the inner portion of flange section 72 serves as a retaining seat for a flat resilient ring 80. The latter is made of an elastomer or other suitable resilient material, e.g., a synthetic rubber such as a butyl or silicone rubber, or a resilient plastic such as a vinyl or urethane polymer. Preferably ring 80 has a durometer value of 45 to 50. Ring 80 has an inner cylindrical surface 82 that is sized so that, unless the ring is deformed, it will make a close but loose fit with a container cap when the chuck is placed over the cap. The ring 80 functions as a compression ring in the manner described hereafter.

The opening 60 in the housing further accommodates a "hat shaped" pusher element 90, which is made of a rigid material such as steel or aluminum. Pusher 90 is free to move vertically within the opening 60 and normally rests upon the upper surface 84 of ring 80, as shown in FIG. 1. The lower end of the pusher 90 is formed with an annular end rib 92, and the upper surface of the pusher is provided with a central, circular recessed area 94 to accommodate a rigid circular wear washer 98, preferably made of steel. Washer 98 is fixed in recess 94, e.g., by a press fit or by welding or by means of screw fasteners. Washer 98 is provided in order to prevent undue wearing of the pusher by cam 6. Therefore, it is preferred that washer 98 be made of a harder material than the pusher 90.

Referring now to FIGS. 1 and 2, when handle 14 is in raised position, cam 6 either barely contacts or is raised from washer 98, so that pusher 90 exerts substantially no compressive force on ring 80. However, as shown in FIG. 2, when handle 14 is moved to its lower limit position, cam 6 is caused to exert a downward force on washer 98, so as to move pusher 90 downwardly enough to cause rib 92 to depress the upper surface 84 of the ring 80, which in turn forces the ring to bulge inwardly in the manner shown in FIG. 2.

The compressed ring chuck of the present invention is particularly useful in a torque measuring apparatus such as shown in U.S. Pat. No. 5,152,182, mentioned hereinabove. In a device such as the one illustrated in said U.S. Pat. No. 5,152,182, a torque shaft applies rotational forces to an adaptor member which is placed about a cap of a container. The level of torque required to unlock the cap from a container is measured. The chuck 1 of the present invention can be employed instead of the adaptor used in the torque measuring apparatus of U.S. Pat. No. 5,152,182. For such purpose the housing 2 is provided with an extension 100 (FIGS. 1 and 2) having a hexagonal or other cross-sectional shape for making a locking connection to the torque mechanism apparatus shown in said U.S. Pat. No. 5,152,182.

By way of example, in order to use the chuck of the present invention for torque testing, a cap or a bottle, such as a smooth metal bottle cap of the type having vestigial threads, is placed within the interior opening defined by flange section 72 of the chuck, as viewed in FIG. 1. The cap (or the chuck) is then moved to a position where the inner surface 82 of ring 80 surrounds, and preferably lightly engages, the periphery of the cap. The cam operating handle 14 is then moved from its upper position (FIG. 1) towards its lowered position (FIG. 2). This handle movement rotates the cam 6 so that point 50 is moved downwardly (clockwise as viewed in FIGS. 1 and 2). Handle 14 is moved down from its raised position far enough to cause cam 6 to bear against washer 98 and thereby cause pusher 90 to move downwardly enough to force its rib 92 to move into the upper surface 84 of the ring 80. Due to the influence of body section 74 of plate 70, this downward movement of pusher 90 compresses ring 80. Since ring 80 cannot expand radially outwardly or move downwardly because of the constraining of the surfaces 76 and 78 of plate 70, it can only expand inwardly when compressed by rib 92. FIG. 2 shows the final position achieved by cam 6 where the point 50 is in the six o'clock position in line with washer 98. At that position the bulged surface 82 of ring 80 has achieved its inwardmost position and shape, surrounding and embracing the periphery of a sample cap (not shown).

It is to be noted that when it is in the position shown in FIG. 2, the cam is effectively locked against rotation back to the position of FIG. 1 since any upward reaction force exerted by pusher 90 tends to be concentrated through the center of the cam and pivot axis 10.

As an illustration of the degree of movement attained by a preferred embodiment of the invention, cam 6 and handle 14 are arranged so that a downward movement of the pusher 90 of about 0.100 inches causes the surface 82 of ring 801to move inwardly about 0.070 inches. By carefully choosing the durometer of the material of flat ring 80, and appropriately designing cam 6 and the extent of movement of cam 6, which in turn causes the pusher 90 to compress the ring 80, the amount of inward movement of the surface 82 of the ring 80, and hence the degree of compression placed on the outer periphery of a cap, can be controlled. By applying compressive forces by means of expansion of an elastomer only, and not by positively moving rigid elements to apply radial forces, excessive radial compression on the cap will be avoided, while still permitting application of a grasping force sufficient to enable a torque to be applied through the connection 100 to screw or unscrew a cap on a container. This result can be further assured or modified by properly dimensioning the inside surface 82 of ring 80 in relation to the outside diameter of the cap to be tested, and also by properly adjusting the degree of rotation of the cam 6 and/or the degree of movement of the cam operating handle 14. In this connection, it is to be understood that the mechanism of FIGS. 1–3 is to be arranged so that the cap to be tested will not be compressed to the point where the torque measurement is distorted.

Although a specific preferred embodiment of the present invention has been described and illustrated herein, it should be appreciated that modifications and variations may be readily made by those skilled in the art without departing from the spirit and scope of the invention. For example, cam 6 may be rotatably mounted within housing 2 by means of a single pivot shaft which passes through and is affixed to the cam and is rotatably mounted to housing 2. In such an arrangement, cam 6 is rotatable on the single pivot shaft, or it may be fixed to the shaft and the latter may be rotatably mounted to housing 2.

Furthermore, the operating handle 14 need not be manually manipulated but instead may be operated by a linearly movable actuator having an operating rod that is pivotably connected to handle 14. Alternatively a simple gearing system may be coupled to cam 6 or handle 14 for effecting rotation of cam 6. Still other changes and modifications of the present invention will be obvious to persons skilled in the art from the foregoing description.

What is claimed is:

1. A chuck for use with a device that is adapted to measure torque resistance between a cap and a container to which said cap is assembled, said chuck comprising:

a hollow chuck housing having first and second opposite ends, said first end being closed off by an end wall and said second end having an end opening, said housing also having a side opening intermediate said first and second ends and transmission means attached to said end wall for connecting said housing to a torque driver whereby said housing can be rotated on its longitudinal axis;

a rigid ring retainer member secured to said housing at said second end thereof, said ring retainer member comprising a hollow cylindrical body that extends within said end opening and is coaxial with said housing and an annular flange that projects radially inward from said body;

an elastomeric ring disposed within said housing, said ring defining an opening for accommodating a cap on a container, said ring being seated on said flange and being surrounded and constrained at its outer periphery by said body, whereby said ring is retained in said housing by said flange and is constrained against outward radial expansion by said body;

a pusher member disposed within said housing in coaxial relation with said ring and said flange, said pusher member comprising a top end remote from said ring and a bottom end adjacent to said ring, said bottom end having an annular rib that is coaxial with and is disposed to engage said ring when said pusher member is forced toward said flange;

camming means for engaging said pusher member and forcing it toward said flange, said camming means comprising a cam disposed within said housing between said pusher member and said end wall and shaft means mounting said cam for rotation on an axis that extends at a right angle to the longitudinal axis of said housing and parallel to the plane of said flange, said cam being mounted for rotation between a first position wherein it exerts substantially no axial force on said pusher member and said pusher member exerts substantially no compressive force to said ring, and a second position wherein it exerts an axial force on said pusher member in a direction to cause said pusher member to compress said ring; and mechanical means for rotating said cam between said first and second positions, said mechanical means comprising a lever arm that is connected to said cam and projects out of said housing via said side opening, said side opening being sized so as to allow said lever arm to be moved enough to rotate said cam from one to the other of said first and second positions;

whereby when a cap is placed within said elastomeric ring and said lever arm is moved so as to rotate said cam from said first position to its said second position, said pusher will compress said ring and said ring will be forced to expand radially inwardly into grasping relation with said cap with sufficient force to enable application of torque to said cap thereto upon rotation of said chuck.

2. A chuck according to claim 1 further including an operating handle affixed to the outer end of said lever arm.

3. A chuck according to claim 1 wherein said top end of said pusher member is provided with a wear plate in position to be engaged by said cam.

4. A chuck according to claim 1 wherein said end opening of said housing is defined by an annular end surface at said second end of said housing, and further wherein said retainer member has a second flange extending radially outward therefrom that overlaps said annular end surface of said housing.

5. A chuck according to claim 1 wherein said cam is circular disk and is mounted eccentrically with respect to its axis of rotation.

* * * * *